United States Patent [19]

Williams

[11] Patent Number: 4,681,218

[45] Date of Patent: Jul. 21, 1987

[54] MOISTURE-CONTROLLED GLASS MICROSCOPE SLIDE PACKAGE

[75] Inventor: Edward L. Williams, Oxnard, Calif.

[73] Assignee: Becton, Dickinson and Company, Franklin Lakes, N.J.

[21] Appl. No.: 358,147

[22] Filed: Mar. 15, 1982

[51] Int. Cl.[4] ..... B65D 81/26

[52] U.S. Cl. ..... 206/204; 34/95; 206/456; 312/31

[58] Field of Search ..... 34/80, 95; 55/274, 384, 55/387; 206/0.5, 204, 454, 456; 426/124; 312/31, 31.2

[56] References Cited

U.S. PATENT DOCUMENTS

| | | | |
|---|---|---|---|
| 1,222,656 | 4/1917 | Moyer | 55/384 |
| 2,197,859 | 4/1940 | Freed | 206/456 |
| 2,283,867 | 5/1942 | Flosdorf et al. | 206/204 |
| 2,524,162 | 10/1950 | Chavannes et al. | 206/204 |
| 2,545,710 | 3/1951 | Snyder | 312/31 |
| 2,674,509 | 4/1954 | Barnet | 206/204 |
| 2,771,333 | 11/1956 | Eberle | 312/31 |
| 2,895,603 | 7/1959 | Freeman | 312/31 |
| 3,084,984 | 4/1963 | Adler | 312/31 |
| 3,235,068 | 2/1966 | Asnes et al. | 206/456 |
| 3,463,301 | 8/1969 | Speelman | 206/456 |
| 3,618,755 | 11/1971 | Kean, Sr. et al. | 206/454 |
| 3,663,239 | 5/1972 | Rowe et al. | 229/3.5 MF |
| 4,036,360 | 7/1977 | Deffeyes | 426/124 |
| 4,240,547 | 12/1980 | Taylor | 206/456 |

FOREIGN PATENT DOCUMENTS

| | | | |
|---|---|---|---|
| 0686964 | 5/1964 | Canada | 312/31 |
| 0711186 | 6/1954 | United Kingdom | 206/204 |

OTHER PUBLICATIONS

"Desiccating in the Package", Talburt et al., *Food Engineering*, Apr., 1954, p. 79.

*Primary Examiner*—Stephen Marcus
*Assistant Examiner*—Jimmy G. Foster
*Attorney, Agent, or Firm*—R. J. Rodrick

[57] ABSTRACT

A package of moisture-controlled glass articles includes a sealed container. A plurality of glass articles is inside the sealed container in surface-to-surface contact with each other. Moisture is prevented from entering the sealed container and there is a mechanism for removing moisture, which preexits inside the container at the time of sealing, at a controllable rate.

12 Claims, 2 Drawing Figures

MOISTURE-CONTROLLED GLASS MICROSCOPE SLIDE PACKAGE

BACKGROUND OF THE INVENTION

1. Field of the Invention

The present invention relates to a package of moisture-controlled glass articles, and more particularly, concerns a package of glass microscope slides into which moisture is prevented from entering and preexisting moisture within is removed at a controlled rate.

2. Description of the Prior Art

Packaged glass articles, and specifically flat, thin glass microscope slides, have a tendency to lose their visual clarity when being stored before use. In addition, and particularly with flat, thin glass articles, storage tends to cause these glass articles to stick together rendering them difficult to separate after the package is opened. When the glass articles of concern are glass microscope slides, it is appreciated that visual deterioration of the glass surfaces is unacceptable since it may interfere with the observer's ability to properly view the substances contained on the slides.

It is believed that moisture acting on the surfaces of glass articles, such as microscope slides, produces a chemical reaction which deteriorates the surfaces causing them to appear dirty and oily. Once this surface deterioration occurs, it undesirably causes the glass slides, which are packaged in a surface-to-surface arrangement, to stick together. The deterioration of the glass surfaces is initiated by moisture ($H_2O$) in its ionic form contacting the glass surfaces. A hydrogen donor is given up by the $H_2O$ to the glass matrix thereby producing the chemical conditions to form sodium hydroxide. A white film then forms out of other substances that are available from the breakdown of the glass structure and carbon dioxide present in the atmosphere. For example, and as a result of this breakdown, the formation of such materials as sodium carbonate and sodium bicarbonate is manifested in white powder form; sodium sulfate and silicic acid residues appears as light white haze on the surface of the glass. White powder and haze on the surfaces of the glass slides are undesirable and are observed as dirt by the user. Moreover, the white film and haze which accumulates may be scraped loose and become intermixed with the sample material placed on the surface of the slide. As a result, the undesirable white powder and haze interferes with the visual examination and subsequent diagnosis of specimens on the surface of a glass microscope slide.

When moisture accumulates on the surfaces of the slides and initiates the glass breakdown process, it also causes a sticking effect. This sticking effect is due to the flat surfaces of the slides in face-to-face arrangement which renders them difficult to separate particularly on an individual basis. It should be kept in mind, however, that the accumulation of moisture on the surfaces of glass microscope slides is not totally undesirable. Specifically, the presence of some moisture on the glass surfaces causes a chemical reaction which increases the surface lubricity thereof, rendering the slides more slippery. A slippery glass surface on a microscope slide, but one which has not visually deteriorated, facilitates the process of blood smear procedures in diagnostic laboratories. Therefore, in many instances, it is desirable to strike a balance between the removal of moisture from packages to obviate the visual deterioration of the glass and the retention of some moisture to render increased lubricity to the glass surface.

With the foregoing in mind, it can be seen that significant improvements in the packaging of glass articles, such as microscope slides, are desired and are still being sought. Accordingly, the present invention is directed toward the solution of the aforementioned problems and desired goals.

SUMMARY OF THE INVENTION

A package of moisture-controlled glass articles of the present invention comprises a sealed container. A plurality of glass articles is inside the sealed container in surface-to-surface contact with each other. Means prevents moisture from entering the sealed container and removes moisture preexisting inside the container at the time of sealing at a controllable rate. In a preferred embodiment of the present invention, the container includes a plurality of flat, thin glass microscope slides stacked in face-to-face arrangement. A desiccant is included in the container for removing substantially all the moisture from the slides over a prolonged period of time. The desiccant is adapted to remove moisture at a rate which permits moisture on the surface of the slides to react with the glass in a chemical reaction which increases the surface lubricity of the slides without causing visual deterioration thereof. In this preferred embodiment, a moisture barrier is sealed around the slides thereby serving as the preventative mechanism so that moisture cannot enter into the sealed container.

In accordance with the principles of the present invention, the elements of the package described herein significantly reduce or eliminate visual deterioration of the glass articles sealed inside the package. Particularly when these glass articles are microscope slides, the conditions of the glass surfaces are significantly improved. White powder and haze is prevented from forming on the surfaces of the microscope slides thereby providing a more clear field of view for the user who is looking through the microscope. The net effect of preventing the white powder or haze from forming is a prolongation of shelf-life of glass microscope slides in the packaged form. Moreover, special storage conditions will not be required with the present invention inasmuch as moisture-controlled features are embodied in the packaged container itself. In addition, to the foregoing, the present invention allows the formation of some moisture on the surfaces of the glass slides so that surface lubricity can be improved. Increased surface lubricity results from the chemical reaction caused by the combination of moisture and glass material out of which the slides are made. Therefore, the present invention provides a balance between the removal of moisture to prevent visual deterioration of the glass slides and retention of some moisture to contribute to the chemical reaction for increasing surface lubricity of the slides.

DETAILED DESCRIPTION

Figure 1:
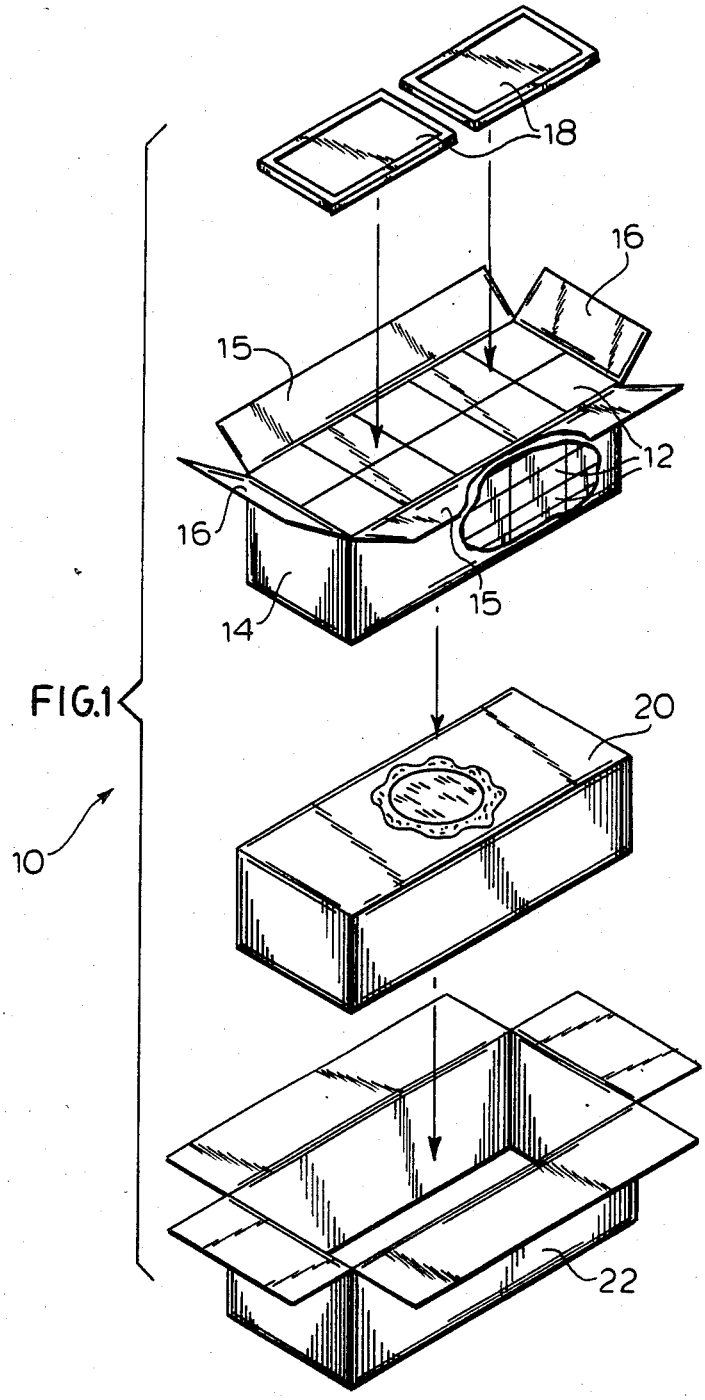
FIG. 1 is a perspective view of the preferred package of moisture-controlled glass microscope slides illustrating sequential packaging of the components of the invention.

While this invention is satisfied embodiments in many different forms, there is shown in the drawing and will herein be described in detail a preferred embodiment of the invention, which the understanding that the present disclosure is to be considered as exemplary of the principles of the invention and is not intended to limit the invention to the embodiment illustrated. The scope of the invention will be measured by the appended claims and there equivalents.

Advertising to FIG. 1, there is illustrated a package assembly 10 for enclosing glass microscope slides 12 in a moisture-controlled environment. While the ensuing description of the present invention will refer to glass microscope slides as part of the moisture-controlled package, it is understood that the features of the present invention are applicable to a wide variety of packaged glass articles, particularly those that are packaged in surface-to-surface contact with each other.

As seen in FIG. 1, a plurality of flat, thin glass microscope slides is assembled in a stacked relationship with the slides being in face-to-face contact with each other in stacked rows. In this embodiment being described, there are fifty microscope slides, stacked in ten adjacently lying columns of five rows each. Of course, the number of glass slides and their sizes and shapes may vary. The stacked slides are positioned in a container 14 which is preferably corrugated for shipping and strength purposes. Container 14 includes two side flaps 15 and two end flaps 16 which fold over slides 12 so that container 14 can be sealed. Container 14 is preferably made of lightweight material, such as paper or lightweight cardboard.

Before the flaps of container 14 are sealed over the glass microscope slides therein, a desiccant is placed inside the container. In this embodiment, the desiccant is in the form of two desiccant packs 18. It is understood that the form of the desiccant material is not critical to the present invention, with desiccant packs 18 merely being representative of one form of the invention. In other instances, the desiccant may be in loose or unpacked form or contained in one or more desiccant receptacles, according to many factors including the type of desiccant being used, the number and sizes of the glass articles, rate of moisture removal, expected temperature ranges, expected humidity conditions, and the like. For purposes of the present invention, and particularly with glass microscope slides, it is customary to package fifty such slides in a single container, as being described and illustrated herein. In order to strike a balance between removing the moisture from inside the container while allowing some moisture to initiate the chemical reaction for increased surface lubricity, it has been determined that, for a package of fifty slides, all the moisture inside of the package should be removed over a period of about thirty days. It is understood that many factors, such as mentioned above, will affect this time frame, with the thirty day period merely being illustrative of one aspect of the present invention.

While desiccant in many forms and materials may be employed for purposes of the present invention, two general categories of desiccant are preferred: dried clay material or silica gel. A preferred embodiment of the dried clay material is dried un-ground Montmorillonite clay. When using Montmorillonite clay with fifty glass microscope slides, with the intention of removing all the moisture inside the package over a period of about thirty days, it is preferred to utilize two desiccant packs 18 with the clay therein. Each pack 18 contains approximately 66.2 grams of Montmorillonite clay, for a total of 132.4 grams per package. This amount of desiccant, in the embodiment being described, should remove all the moisture inside the container and from the glass slides at a controlled rate over a prolonged period of time, in this instance about thirty days. The rate of moisture removal or absorption can be varied by the amounts and types of desiccant being utilized inside the container.

After desiccant packs 18 are positioned inside container 14 with the glass slides, the container is sealed, in conjunction with the aforementioned flaps. A moisture barrier material 20 is then sealed around container 14 enclosing the desiccant packs and microscope slides. Moisture barrier 20 may be provided in a number of forms including two embodiments which are readily evident. In the first instance, container 14 may be fabricated with a liner which is impermeable to moisture, and which is adaptable to being hermetically sealed. Preferably, a plastic coated foil liner will serve as such a moisture impermeable barrier. On the other hand, moisture barrier 20 may be placed around sealed container 14 as a separate wrap. Once again, a plastic coated foil sheet is a preferred material for providing a moisture-impermeable barrier. In either instance described above, it is preferred that moisture barrier 20 be hermetically sealed around container 14 so that the microscope slides enclosed therein are in a moisture-controlled environment. Specifically, barrier material 20 serves to prevent moisture from entering into the container; on the other hand, desiccant packs 18 serve to controllably remove moisture, which pre-exists inside the container at the time of sealing, at a controllable rate.

To protect moisture barrier 20 from being torn or abused during shipping, handling and storage, it is preferred that the entire moisture sealed container be positioned in a shipping carton 22. Carton 22 may be similar to container 14, and is sealed around the moisture-sealed container positioned within. The final package thus represents a sealed carton having a moisture-sealed container immediately therein, the container including glass microscope slides stacked in face-to-face relationship with a desiccant inside the container for controllably removing moisture therein.

Figure 2:
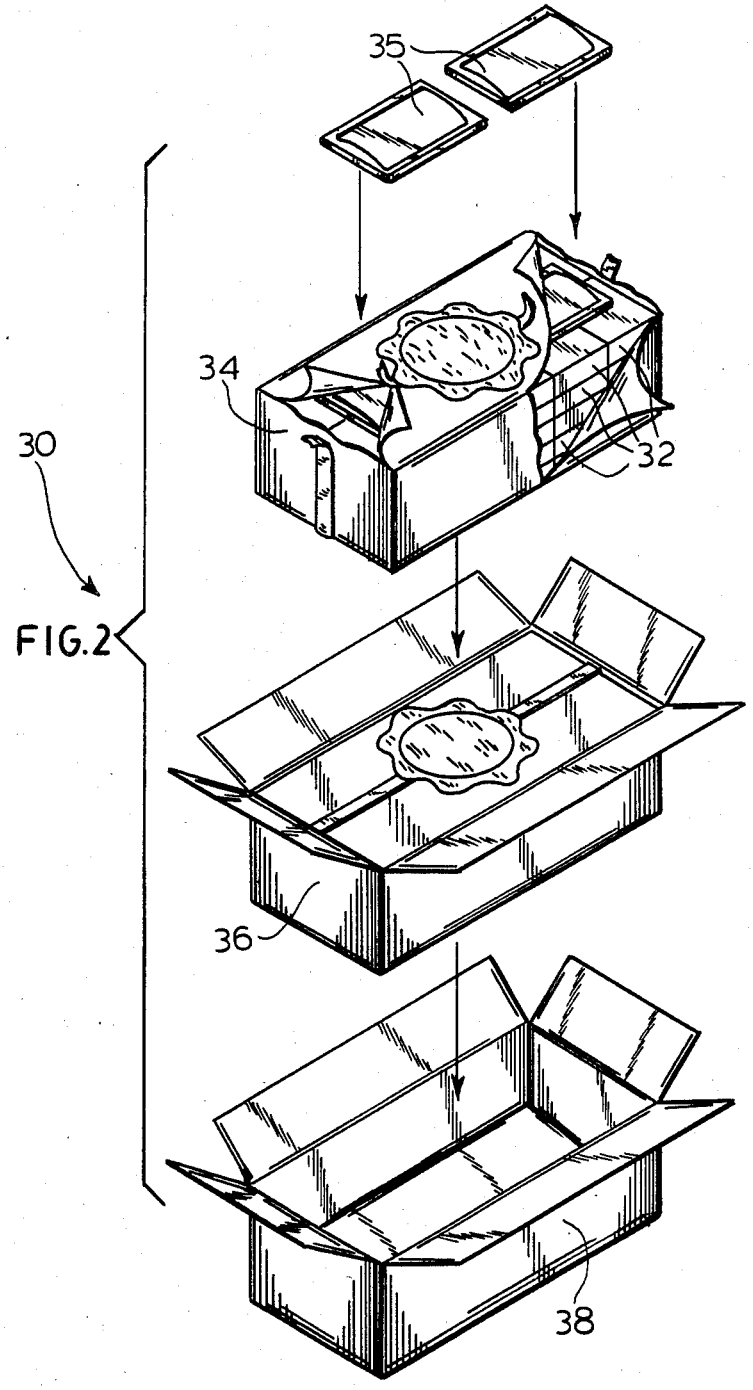
FIG. 2 is a perspective view of a package similar to that of FIG. 1, but with an alternative manner of sequential packaging of the components.

Instead of the packaging technique described above, the sequential packaging steps of the components of the present invention may be altered as illustrated in FIG. 2. Package assembly 30 preferably encloses a plurality of glass microscope slides 32 (or other glass articles) in a moisturecontrolled environment. However, the slides are first directly enclosed by moisture barrier material 34 (substantially as described above), with the desiccant packs 35 also being enclosed within the moisture barrier material. Then, the packaged subassembly in placed in a container 36 which is preferably corrugated for shipping and strength purposes. Finally, the assembly may be placed in a shipping carton 38 so that all of the contents are well protected.

Not only will the present invention prolong the shelf-life of the glass microscope slides, and eliminate requirements of special storage, but also prepare the microscope slides for increased surface lubricity which is significantly desirable for many laboratory tests. For example, in the procedure of producing a blood smear, a glass spreader slide is slid over a glass specimen slide.

Under normal conditions, two pieces of fresh clean glass mated in edge-to-face relationship are very abrasive. This abrasiveness interferes with the smooth sliding action demanded of the spreader slide over the specimen slide. Therefore, a small amount of moisture on these slides provides a condition that reduces the abrasiveness of the glass surfaces and allows the smooth sliding action of the spreader slide along the surface of the specimen slide. This small amount of moisture is provided by the features of the present invention which prevents visual deterioration of the glass slides which are packaged according to the foregoing description, while also initiating a chemical reaction which increases the surface lubricity of the glass slides.

Thus, the present invention provides the user who opens the package as described above with glass slides that are visually clear and sufficiently slippery to facilitate the sliding action of one glass slide over another. Furthermore, the slides of the present package are able to be separated in individual fashion since the present invention eliminates or substantially reduces the inherent sticking problems found in presently known glass microscope slide packages.

What is claimed is:

1. A package of moisture-controlled glass microscope slides comprising:

a container; a plurality of flat, thin glass microscope slides inside said container stacked in face-to-face arrangement; a moisture barrier sealed around said container; and a desiccant inside the space sealed by said moisture barrier for removing substantially all the moisture from the slides over a prolonged period of time at a rate which permits moisture on the surfaces of said slides to react with the glass in a chemical reaction which increases the surface lubricity of said slides without causing visual deterioration of said slides.

2. The package of claim 1 wherein said moisture barrier is hermetically sealed around said container.

3. The package of claim 2 wherein said moisture barrier comprises a plastic coated foil liner.

4. The package of claim 1 wherein said desiccant removes moisture at a rate which permits moisture on the surfaces of said slides to react with the glass in a chemical reaction which increases the surface lubricity of said slides without causing visual deterioration of said slides.

5. The package of claim 4 wherein said desiccant is pre-selected to controllably remove substantially all of said moisture from the glass slides inside said moisture barrier within thirty (30) days from being sealed therein.

6. The package of claims 4 or 5 wherein said desiccant is dried un-ground Montmorillonite clay.

7. A package of moisture-controlled glass articles comprising:

a sealed container;

a plurality of glass articles inside said sealed container in surface-to-surface contact with each other; and means for preventing moisture from entering said sealed container and for removing moisture pre-existing inside said container at the time of sealing at a controllable rate which permits moisture on the surfaces of said articles to react with the glass in a chemical reaction which increases the surface lubricity of said articles without causing visual deterioration of said articles.

8. The package of claim 7 wherein said means includes a desiccant.

9. A package of moisture-controlled glass microscope slides comprising:

a container including a plurality of flat, thin glass microscope slides stacked in face-to-face arrangement and a desiccant for removing substantially all the moisture from the slides over a prolonged period of time, said desiccant adapted to remove moisture at a rate which permits moisture on the surfaces of said slides to react with the glass in a chemical reaction which increases the surface lubricity of said slides without causing visual deterioration of said slides; and moisture barrier means preventing moisture from entering said package.

10. The package of claim 9 wherein said moisture barrier means is hermetically sealed around said container.

11. The package of claim 9 wherein said moisture barrier means is hermetically sealed around said slides.

12. A package of moisture-controlled glass microscope slides comprising:

a container; a plurality of flat, thin glass microscope slides inside said container stacked in face-to-face arrangement; a moisture barrier sealed directly around said slides; and a desiccant inside the space sealed by said moisture barrier for removing substantially all the moisture from the slides over a prolonged period of time at a rate which permits moisture on the surfaces of said slides to react with the glass in a chemical reaction which increases the surface lubricity of said slides without causing visual deterioration of said slides.

* * * * *